US007034769B2

(12) United States Patent
Surducan et al.

(10) Patent No.: US 7,034,769 B2
(45) Date of Patent: Apr. 25, 2006

(54) MODIFIED PRINTED DIPOLE ANTENNAS FOR WIRELESS MULTI-BAND COMMUNICATION SYSTEMS

(75) Inventors: Emanoil Surducan, Cluj-Napoca (RO); Daniel Iancu, Pleasantville, NY (US); John Glossner, Carmel, NY (US)

(73) Assignee: Sandbridge Technologies, Inc., White Plains, NY (US)

( * ) Notice: Subject to any disclaimer, the term of this patent is extended or adjusted under 35 U.S.C. 154(b) by 85 days.

(21) Appl. No.: 10/718,568

(22) Filed: Nov. 24, 2003

(65) Prior Publication Data

US 2005/0110696 A1 May 26, 2005

(51) Int. Cl.
*H01Q 9/16* (2006.01)

(52) U.S. Cl. ..... 343/793; 343/795; 343/700 MS

(58) Field of Classification Search ..... 343/793, 343/795, 792, 700 MS, 702, 829, 846
See application file for complete search history.

(56) References Cited

U.S. PATENT DOCUMENTS

| | | | | |
|---|---|---|---|---|
| 4,205,317 A | | 5/1980 | Young | 343/720 |
| 4,438,437 A | | 3/1984 | Burgmyer | 343/770 |
| 5,030,962 A | | 7/1991 | Rees | 343/700 MS |
| 5,532,708 A | * | 7/1996 | Krenz et al. | 343/795 |
| 5,949,383 A | | 9/1999 | Hayes et al. | 343/795 |
| 5,986,606 A | | 11/1999 | Kossiavas et al. | 343/700 MS |
| 6,072,434 A | | 6/2000 | Papatheodorou | 343/700 MS |
| 6,239,765 B1 | | 5/2001 | Johnson et al. | 343/795 |
| 6,275,192 B1 | | 8/2001 | Kim | 343/700 MS |
| 6,300,908 B1 | | 10/2001 | Jecko et al. | 343/700 MS |
| 6,346,921 B1 | | 2/2002 | Excell et al. | 343/792.5 |
| 6,353,443 B1 | | 3/2002 | Ying | 345/702 |
| 6,404,394 B1 | * | 6/2002 | Hill | 343/702 |
| 6,407,710 B1 | | 6/2002 | Keilen et al. | 343/702 |
| 6,429,818 B1 | | 8/2002 | Johnson et al. | 343/702 |
| 6,509,882 B1 | | 1/2003 | McKivergan | 343/818 |
| 6,603,430 B1 | | 8/2003 | Hill et al. | 343/702 |
| 6,621,464 B1 | | 9/2003 | Fang et al. | 343/795 |
| 6,624,793 B1 | | 9/2003 | Su et al. | 343/795 |
| 6,859,176 B1 | * | 2/2005 | Choi | 343/700 MS |
| 2004/0056805 A1 | * | 3/2004 | Chen | 343/700 MS |
| 2004/0140941 A1 | * | 7/2004 | Joy et al. | 343/795 |

(Continued)

FOREIGN PATENT DOCUMENTS

GB 1550809 8/1979

(Continued)

OTHER PUBLICATIONS

Smith, K.: "Antennas for low power applications," RFM®, AN36A-070898, undated.

(Continued)

*Primary Examiner*—Trinh Vo Dinh
(74) *Attorney, Agent, or Firm*—Barnes & Thornburg LLP

(57) ABSTRACT

A dipole antenna for a wireless communication device, which includes a first conductive element superimposed on a portion of and separated from a second conductive element by a first dielectric layer. A first conductive via connects the first and second conductive elements through the first dielectric layer. The second conductive element is generally U-shaped. The second conductive element includes a plurality of spaced conductive strips extending transverse from adjacent ends of the legs of the U-shape. Each strip is dimensioned for a different center frequency λ0. The first conductive element may be L-shaped, and one of the legs of the L-shape being superimposed on one of the legs of the U-shape. The first conductive via connects the other leg of the L-shape to the other leg of the U-shape.

19 Claims, 15 Drawing Sheets

U.S. PATENT DOCUMENTS

| | | | | |
|---|---|---|---|---|
| 2004/0252070 | A1* | 12/2004 | Chuang | 343/795 |
| 2005/0068243 | A1* | 3/2005 | Chen | 343/790 |

FOREIGN PATENT DOCUMENTS

| | | |
|---|---|---|
| WO | WO 01/15270 | 3/2001 |
| WO | WO 02/23669 | 3/2002 |

OTHER PUBLICATIONS

Wang, H.Y. et al.: "Simulation of microstrip small antennas," Vector Fields Limited, UK, APP-025-06-02, undated.
McKinzie, W. et al.: "Novel packaging approaches for miniature antennas," IMAPS/SMTA Conf. on Telecom Hardware Solutions, Plano, TX (May 2002).
Fiedziuszko, S.J. et al.: "Dielectric materials, devices, and circuits," IEEE Trans. Microwave Theory Tech., vol. 50, pp. 706-719 (Mar. 2002).
Kaneda, N. et al.: "A broad-band planar quasi-Yagi antenna," IEEE Trans. Antennas Propagat., vol. 50, pp. 1158-1160 (Aug. 2002).
Li, R. et al.: "Development and analysis of a folded shorted-patch antenna with reduced size," School of Electrical & Computer Engineering, Georgia Institute of Technology, Atlanta, GA, undated.
Faton Tefiku, *Design of Broad-Band and Dual-Band Antennas Comprised of Series-Fed Printed-Strip Dipole Pairs*, Jun. 1, 2000, pp. 895-900.

* cited by examiner

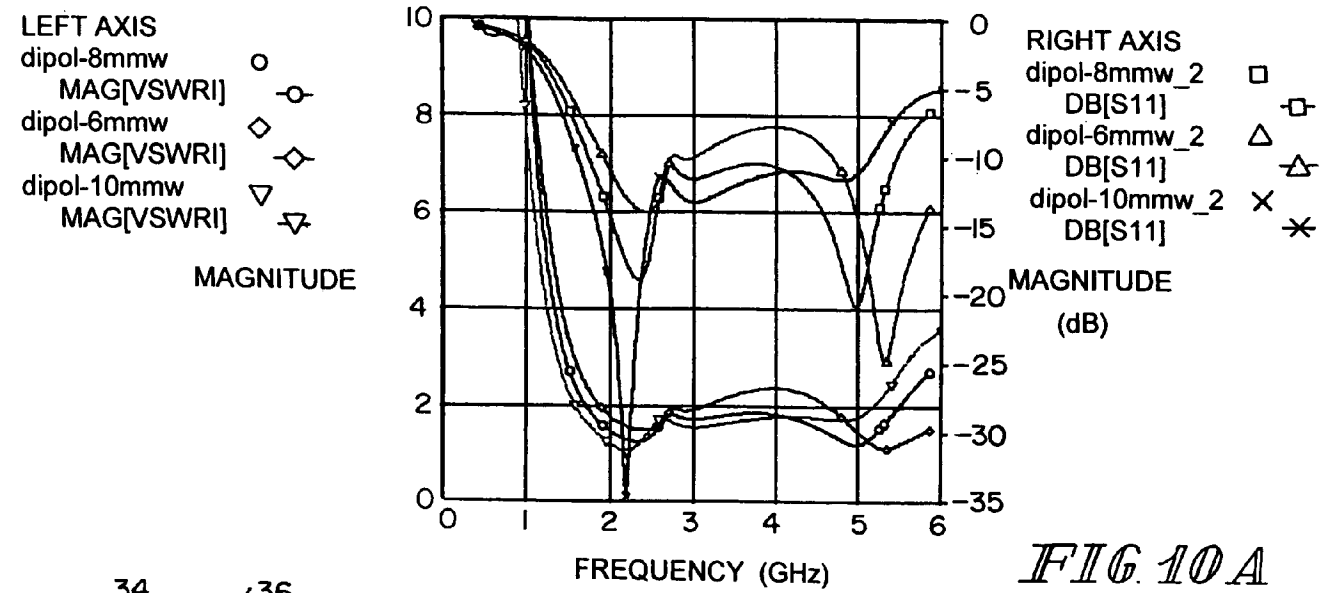
FIG. 10A
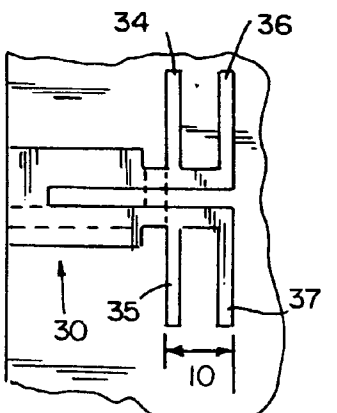
FIG. 10B2
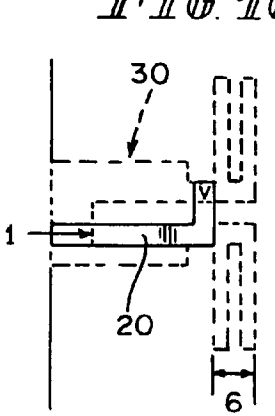
FIG. 10B3
FIG. 10B1

MODIFIED PRINTED DIPOLE ANTENNAS FOR WIRELESS MULTI-BAND COMMUNICATION SYSTEMS

BACKGROUND AND SUMMARY OF THE DISCLOSURE

The present disclosure relates to an antenna for wireless communication devices and systems and, more specifically, to printed dipole antennas for communication for wireless multi-band communication systems.

Wireless communication devices and systems are generally hand held or are part of portable laptop computers. Thus, the antenna must be of very small dimensions in order to fit the appropriate device. The system is used for general communication, as well as for wireless local area network (WLAN) systems. Dipole antennas have been used in these systems because they are small and can be tuned to the appropriate frequency. The shape of the printed dipole is generally a narrow, rectangular strip with a width less than 0.05 λ0 and a total length less than 0.5 λ0. The theoretical gain of the isotrope dipole is generally 2.5 dB and for a double dipole is less than or equal to 3 dB. One popular printed dipole antenna is the planar inverted-F antenna (PIFA).

The present disclosure is a dipole antenna for a wireless communication device. It includes a first conductive element superimposed on a portion of and separated from a second conductive element by a first dielectric layer. A first conductive via connects the first and second conductive elements through the first dielectric layer. The second conductive element is generally U-shaped. The second conductive element includes a plurality of spaced conductive strips extending transverse from adjacent ends of the legs of the U-shape. Each strip is dimensioned for a different center frequency λ0. The first conductive element may be L-shaped and one of the legs of the L-shape being superimposed on one of the legs of the U-shape. The first conductive via connects the other leg of the L-shape to the other leg of the U-shape.

The first and second conductive elements are each planar. The strips have a width of less than 0.05 λ0 and a length of less than 0.5 λ0.

The antenna may be omni-directional or uni-dimensional. If it is uni-dimensional, it includes a ground plane conductor superimposed and separated from the second conductive element by a second dielectric layer. A third conductive element is superimposed and separated from the strips of the second conductive element by the first dielectric layer. A second conductive via connects the third conductive element to the ground conductor through the dielectric layers. The first and third conductive elements may be co-planar. The third conductive element includes a plurality of fingers superimposed on a portion of lateral edges of each of the strips.

These and other aspects of the present disclosure will become apparent from the following detailed description of the disclosure, when considered in conjunction with accompanying drawings.

BRIEF DESCRIPTION OF DRAWINGS

FIG. 10A is a graph showing the effects of changing the width of the dipole of FIG. 1, as illustrated in FIG. 10B.

DETAILED DESCRIPTION OF THE PREFERRED EMBODIMENTS

Although the present antenna of a system will be described with respect to WLAN dual frequency bands of, e.g., approximately 2.4 GHz and 5.2 GHz, the present antenna can be designed for operation in any of the frequency bands for portable, wireless communication devices. These could include GPS (1575 MHz), cellular telephones (824–970 MHz and 860–890 MHz), some PCS devices (1710–1810 MHz, 1750–1870 MHz and 1850–1990 MHz), cordless telephones (902–928 MHz) or Blue Tooth Specification 2.4–2.5 GHS frequency ranges.

Figure 1:
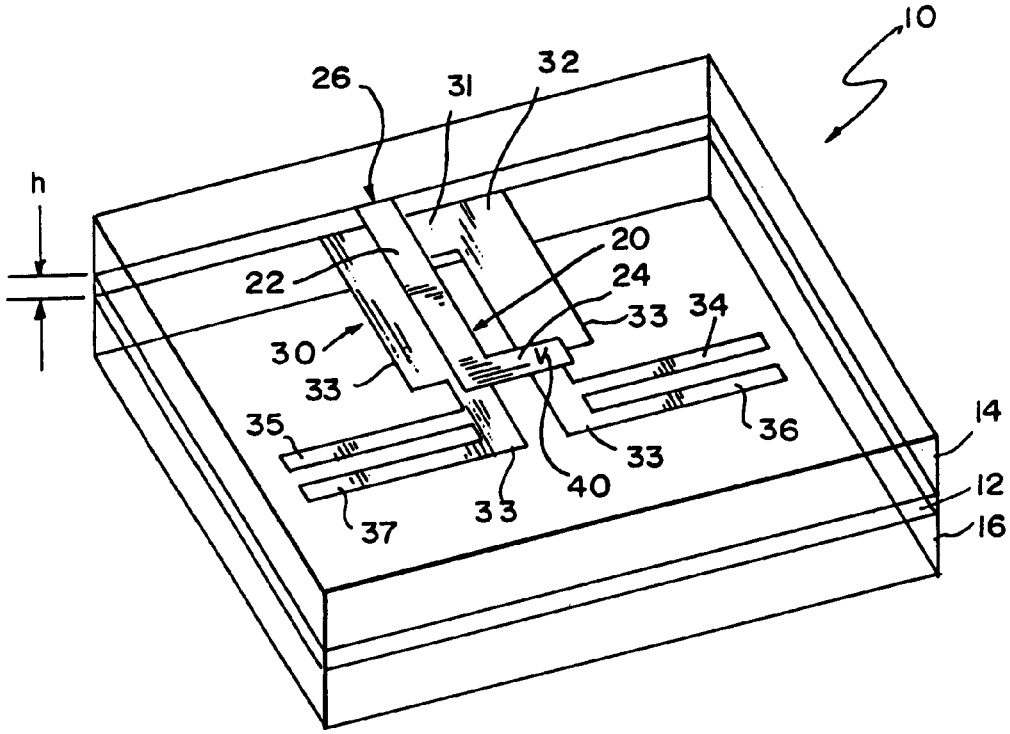
FIG. 1 is a perspective, diagrammatic view of an omni-directional, quad-band dipole antenna incorporating the principles of the present invention.
Figure 2A:
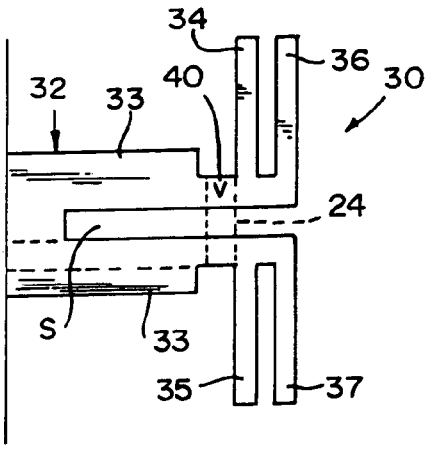
FIG. 2A is a plane view of the dipole conductive layers of FIG. 1.
Figure 3:
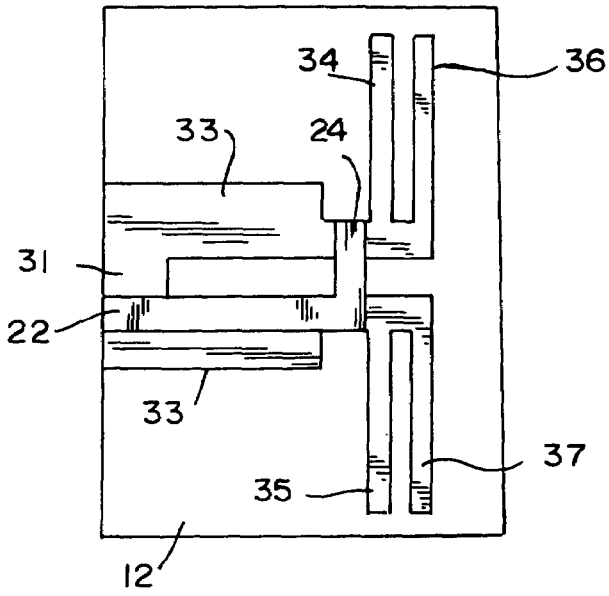
FIG. 3 is a plane view of the antenna of FIG. 1.

The antenna system 10 of FIGS. 1, 2A and 3 includes a dielectric substrate 12 with cover layers 14, 16. Printed on the substrate 12 is a first conductive layer 20, which is a micro-strip line, and on the opposite side is a split dipole conductive layer 30. The first conductive layer 20 is generally L-shaped having legs 22, 24. The second conductive layer 30 includes a generally U-shaped strip balloon line portion 32 having a bight 31 and a pair of separated legs 33. Extending transverse and adjacent the ends of the legs 33 are a plurality of strips 35, 37, 34, 36. Leg 22 of the first conductive layer 20 is superimposed upon one of the legs 33 of the second conductive layer 30 with the other leg 24 extending transverse a pair of legs 33. A conductive via 40 connects the end of leg 24 to one of the legs 33 through the dielectric substrate 12. Terminal 26 at the other end of leg 22 of the first conductive layer 20 receives the drive for the antenna 10.

The four strips 34, 36, 35 and 37 are each uniquely dimensioned so as to be tuned to or receive different frequency signals. They are each dimensioned such that the strip has a width less than 0.05 λ0 and a total length of less than 0.5 λ0.

Figure 2B:
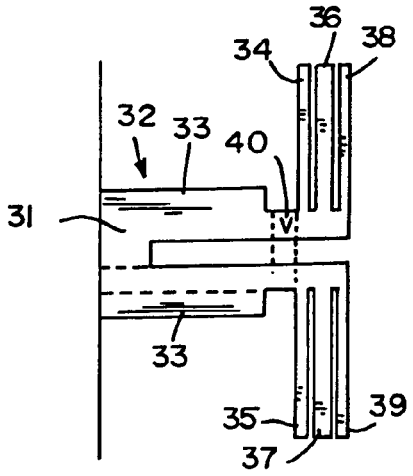
FIG. 2B is a six-band modification of the dipole conductive layer of FIG. 2A.

FIG. 2B shows a modification of FIG. 2A, including six strips 35, 37, 39, 34, 36, 38 each extending from an adjacent end of the legs 33 of the second conductive layer 30. This allows tuning and reception to six different frequency bands. The strips of both embodiments are generally parallel to each other.

The dielectric substrate 12 may be a printed circuit board, a fiberglass or a flexible film substrate made of polyimide. Covers 14, 16 may be additional, applied dielectric layers or may be hollow casing structures. Preferably, the conductive layers 20, 30 are printed on the dielectric substrate 12.

Figure 4:
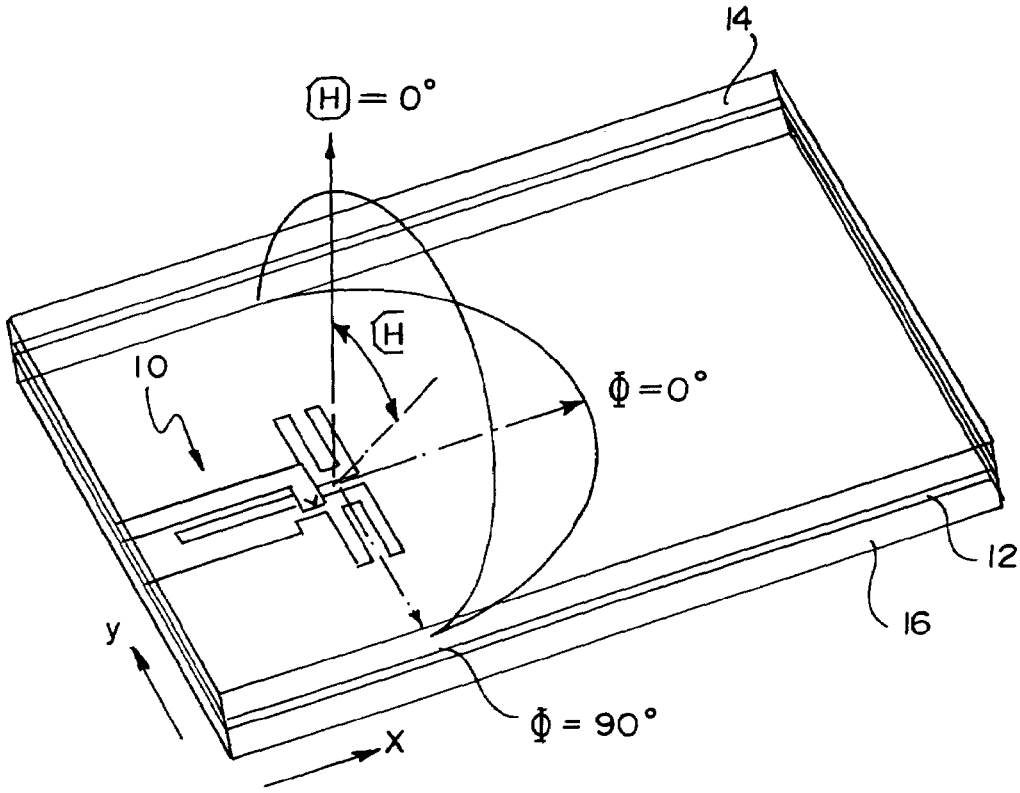
FIG. 4 is a directional diagram of the antenna of FIG. 1.
Figure 5:
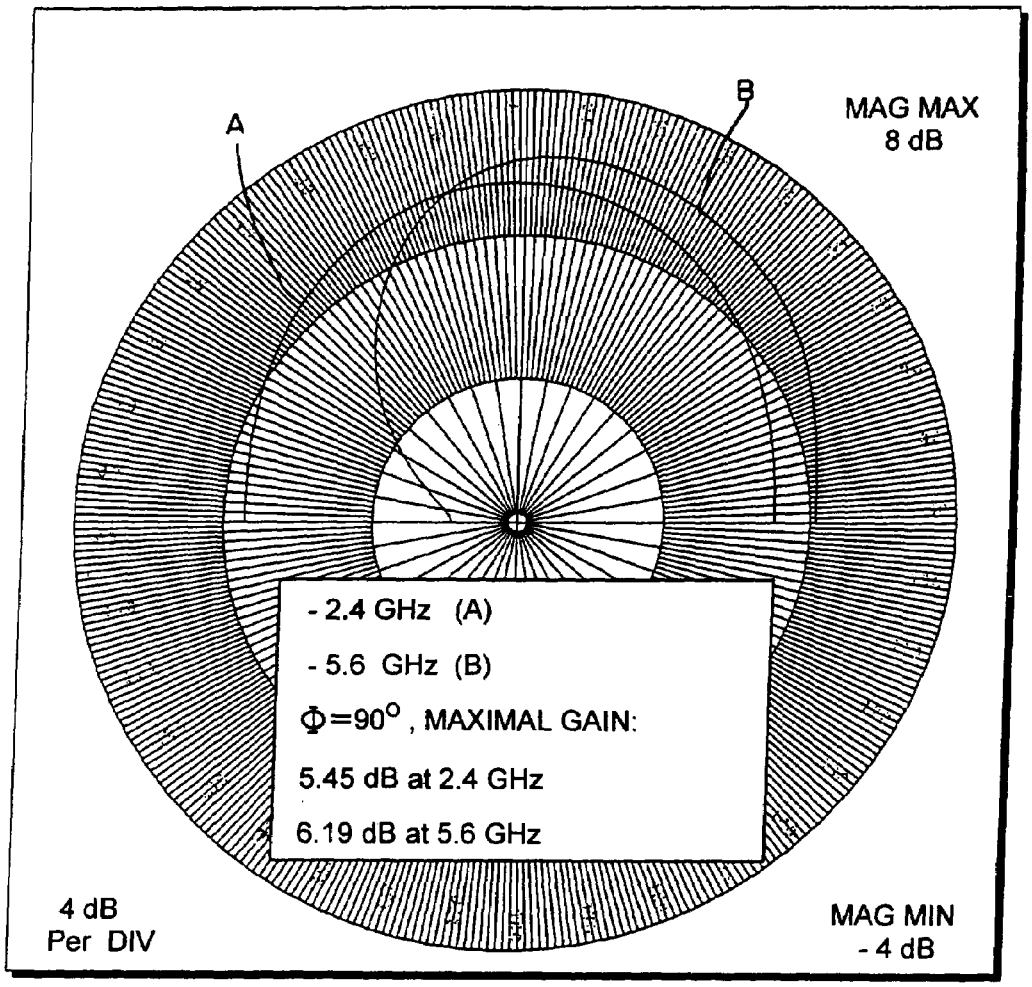
FIG. 5 is a graph of the directional gain of two of the tuned frequencies.
Figure 6:
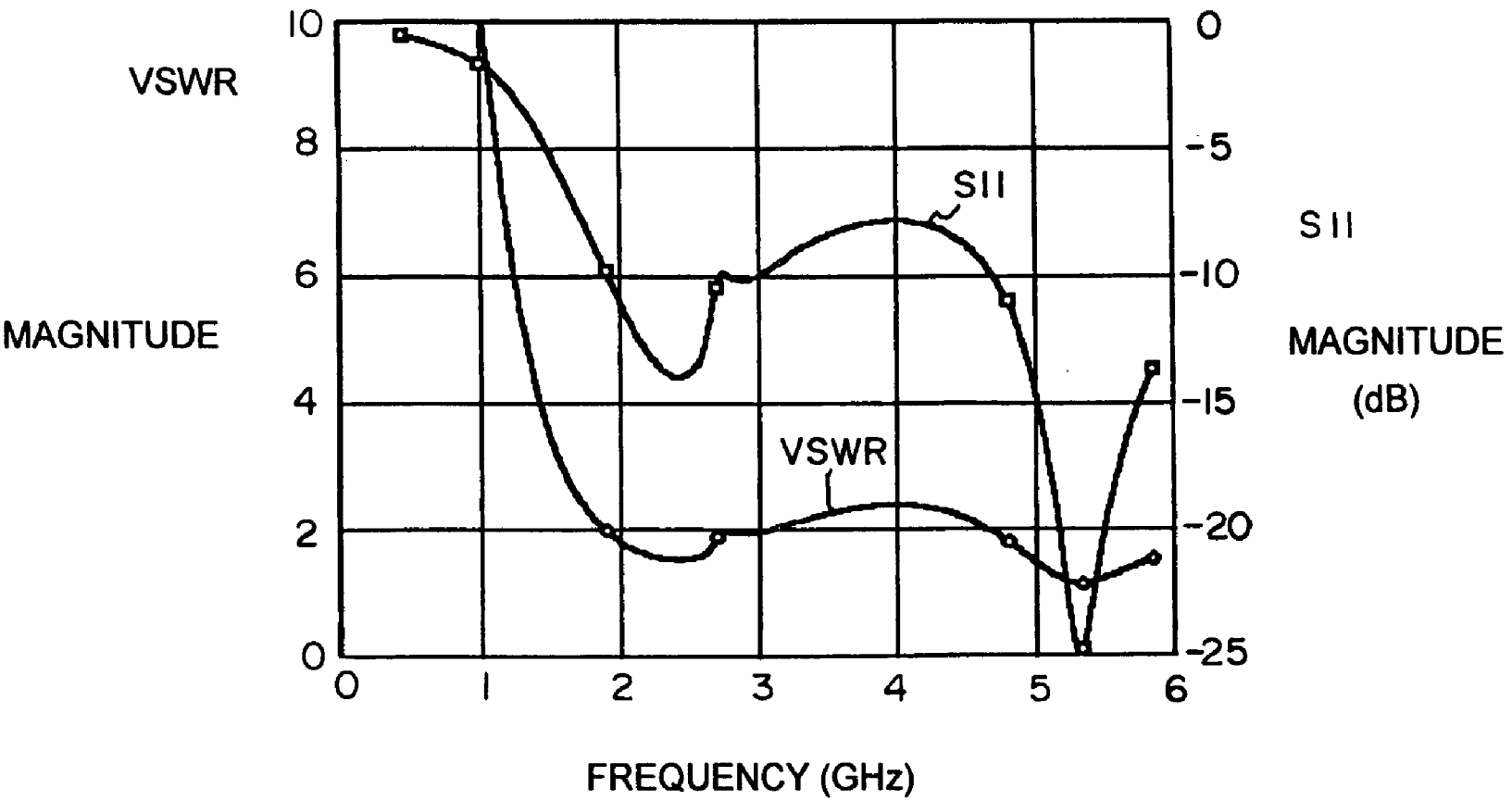
FIG. 6 is a graph of the frequency versus voltage standing wave ratio (VSWR) and the gain of S11.

As an example of the quad-band dipole antenna of FIG. 1, the frequencies may be in the range of, for example, 2.4–2.487, 5.15–5.25, 2.25–5.35 and 5.74–5.825 GHz. For the directional diagram of FIG. 4, the directional gain is illustrated in FIG. 5 for two of the frequencies 2.4 GHz (Graph A) and 5.6 GHz (Graph B). A maximal gain at 90 degrees is 5.45 dB at 2.4 GHz and 6.19 dB at 5.6 GHz. VSWR and the magnitude S11 are illustrated in FIG. 6. VSWR is below 2 at the 2.4 GHz and the 5.6 GHz frequency bands. The bands from 5.15–5.827 merge at the 5.6 GHz frequency.

The height h of the dielectric substrate 12 will vary depending upon the permeability or dielectric constant of the layer.

The narrow, rectangular strips 34, 36, 35, 37 of the appropriate dimension increases the total gain by reducing the surface waves and loss in the conductive layer. The number of conductive strips also effects the frequency sub-band.

The position of the via 40 and the slot S between the legs 33 of the U-shaped sub-conductor 32 effect the antenna performance related to the gain "distributions" in the frequency bands. A width of slot dimensions S and the location of the via 40 are selected so as to have approximately the same gain in all of the frequency bands of the strips 34, 36, 35, 37. The maximum theoretical gain obtained are above 4 dB and are 5.7 dB at 2.4 GHz and 7.5 dB at 5.4 GHz.

Figure 7A:
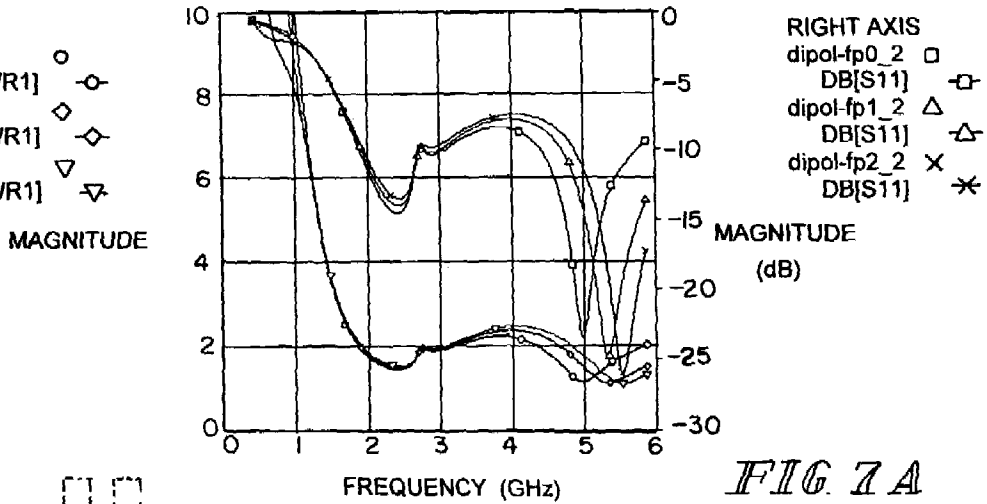
FIG. 7A is a graph showing the effects of changing the feed point or via on the characteristics of the dipole antenna of FIG. 1, as illustrated in FIG. 7B.

FIG. 7A is a graph for the various positions of the feed point fp or via 40 and the effect on VSWR and S11. The center feed point fp1 corresponds to the results of FIG. 6. Although the change of the feed point fp has a small effect in gain, it has a greater effect in shifting the λ0 at the second frequency band in the 5 GHz range.

Figure 8:
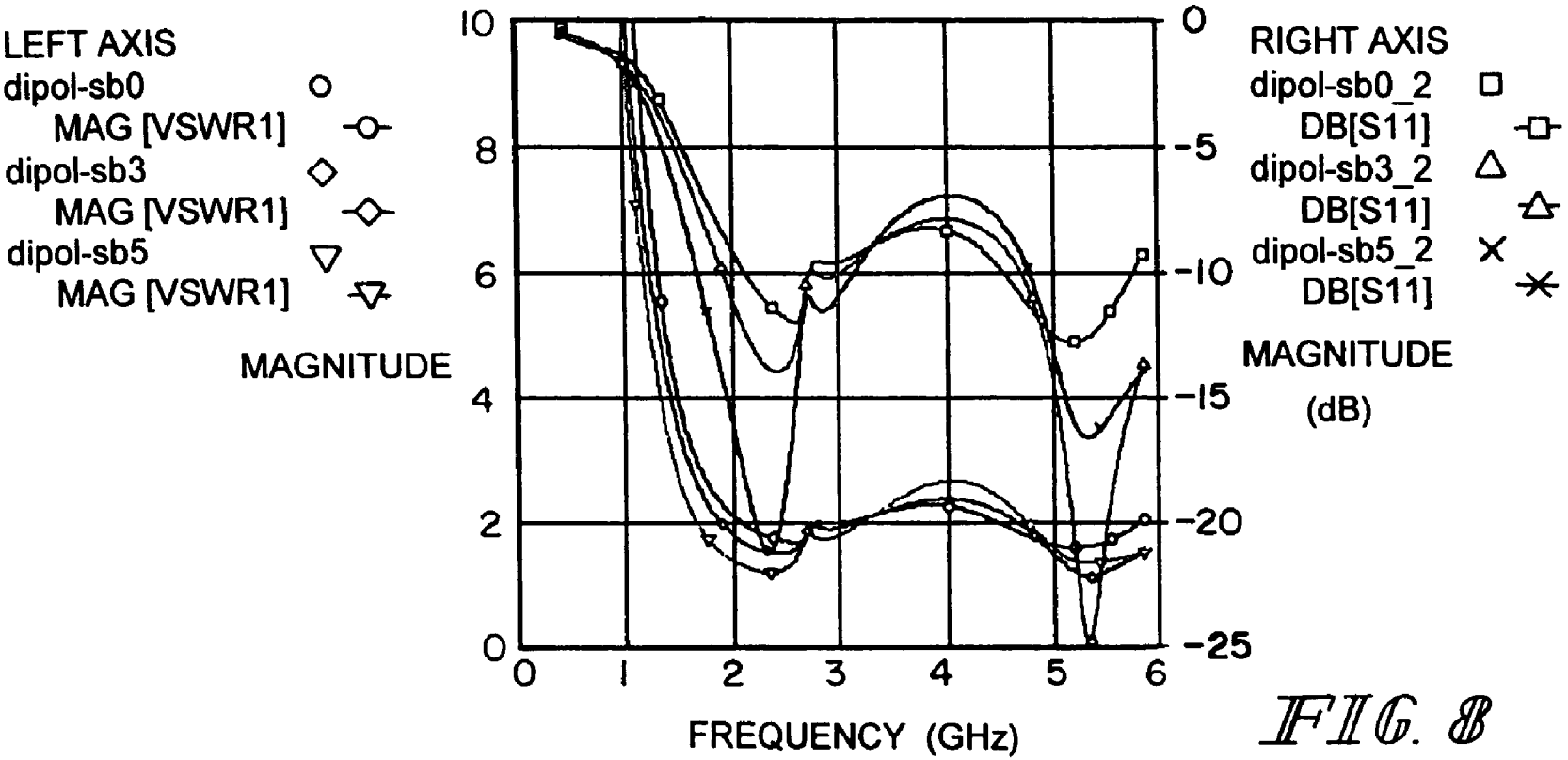
FIG. 8 is a graph showing the effects of changing the width of the slot S of the dipole of FIG. 1.

FIG. 8 shows the effect of changing the slot width from 1 mm to 3 mm to 5 mm. The 3 mm slot width corresponds to FIG. 6. Although there is not much change in the VSWR, there is substantial change in the gain at S11. For example, for the 5 mm strip, S11 is −21 dB at 2.5 GHz and −16 dB at 5.3 GHz. For the 3.3 mm strip, S11 is −14 dB at 2.5 GHz and −25 dB at 5.23 GHz. For the 1 mm strip, S11 is approximately equal to −13 dB at 2.5 GHz and at 5.3 GHz.

Figure 9:
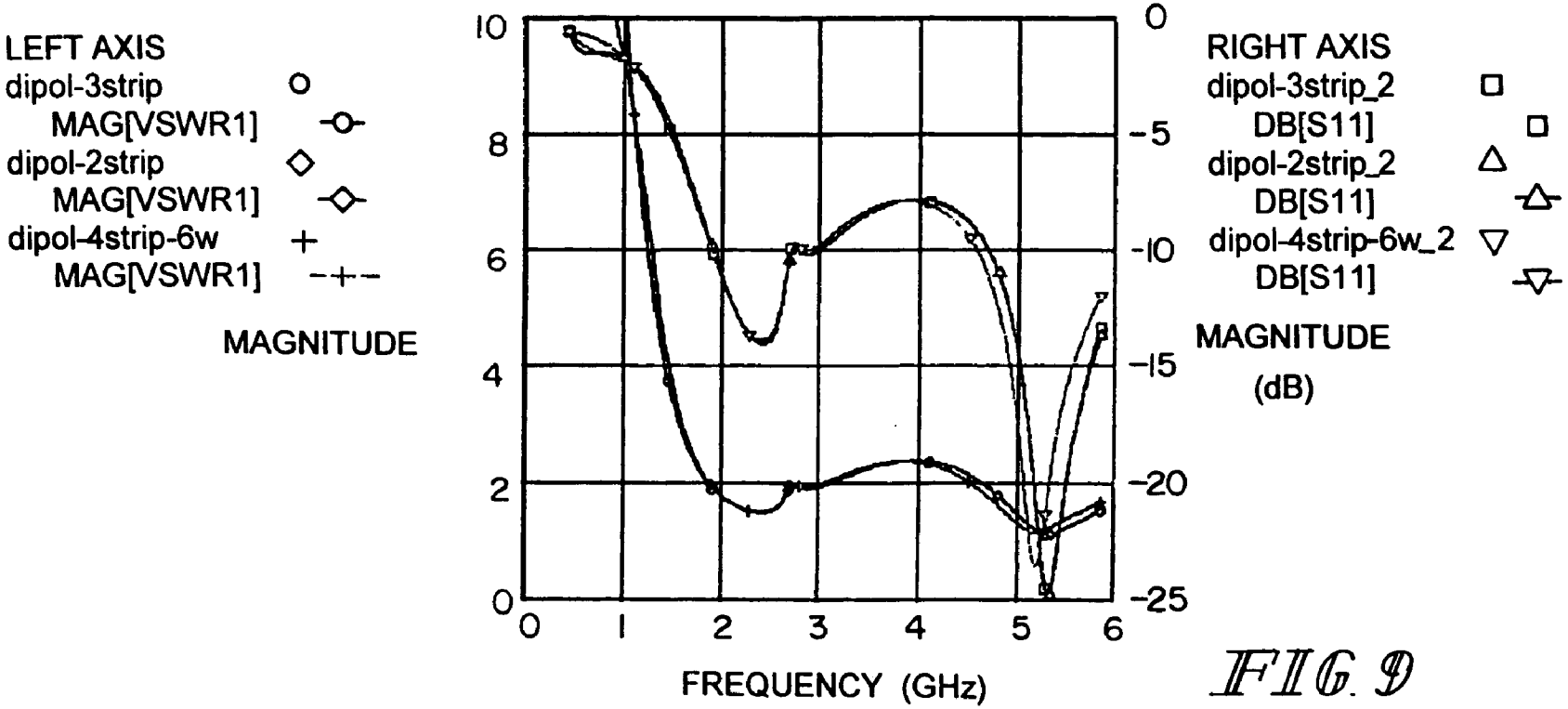
FIG. 9 is a graph showing the effects for a 2-, 3- and 4-strip dipole of FIG. 1.

It should be noted that changing the length of legs 34, 35, 36, 37 between 5 mm, 10 nm and 15 mm has very little effect on VSWR and the gain at S11. FIG. 6 corresponds to a 15 mm length. Also, changing the distance between the legs 34, 35, 36, 37 to between 1 mm, 2 mm and 4 mm also has very little effect on VSWR and the gain at S11. Two millimeters of separation is reflected in FIG. 6. The difference in gain between the 2 mm and the 4 mm spacing was approximately 2 dB. FIG. 9 shows the response of 2, 3 and 4 dipole strips.

FIGS. 10A and 10B show the effect of changing the width of the dipole while maintaining the width of the individual strips. The width of the dipole varies from 6 mm, 8 mm to 10 mm. The 6 mm width corresponds to that of FIG. 6. For the 6 mm width, there are two distinct frequency bands at 2.4 having an S11 gain of −14 dB and at 5.3 GHz having an S11 gain of −25 dB. For the 8 mm width, there is one large band having a VSWR below two extending from 1.74 to 5.4 GHz and having an S11 gain of approximately 20 dB. Similarly, the 10 mm width is one large band at a VSWR below two extending from 1.65 to 5.16 GHz and having a gain at 2.2 GHz of −34 dB to a gain at 4.9 GHz of −11 dB.

Figure 7B:
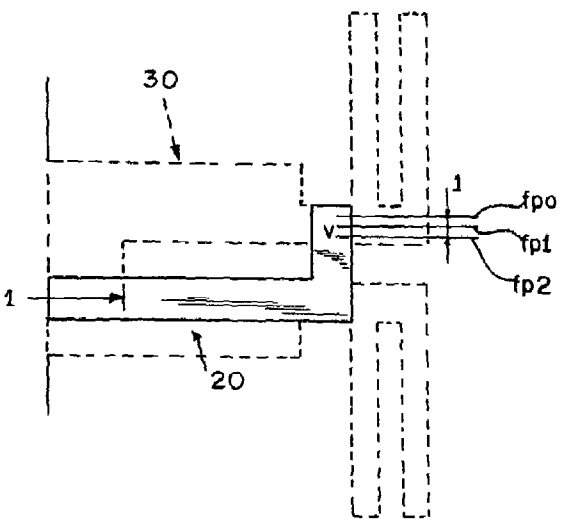

A directional or unidirectional dipole antenna incorporating the principles of the present invention is illustrated in FIGS. 7 through 9. Those elements having the same structure, function and purpose as that of the omni-directional antenna of FIG. 1 have the same numbers.

Figure 11:
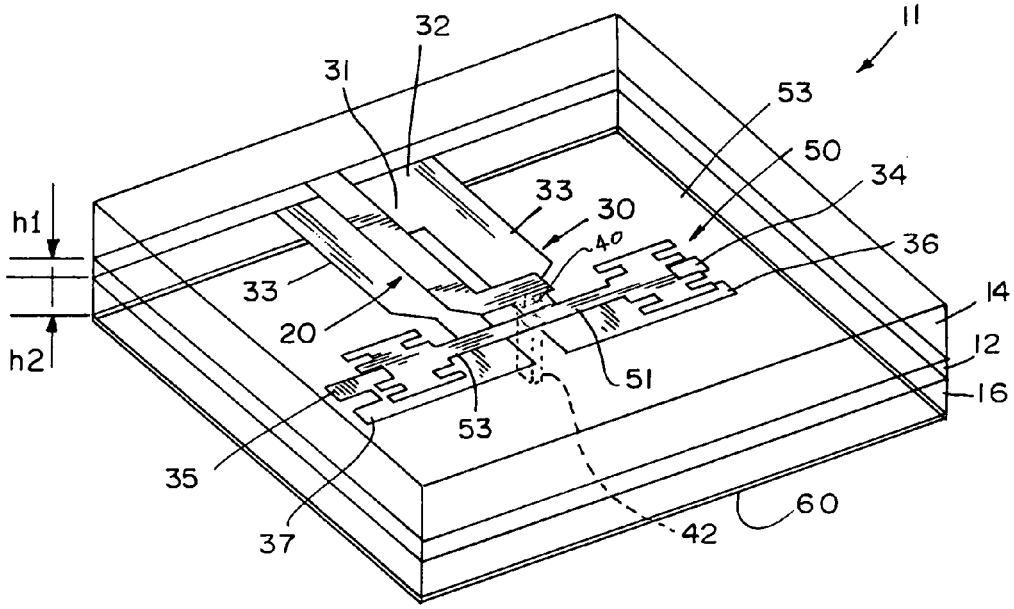
FIG. 11 is a perspective, diagrammatic view of a directional dipole antenna incorporating the principles of the present invention.
Figure 12:
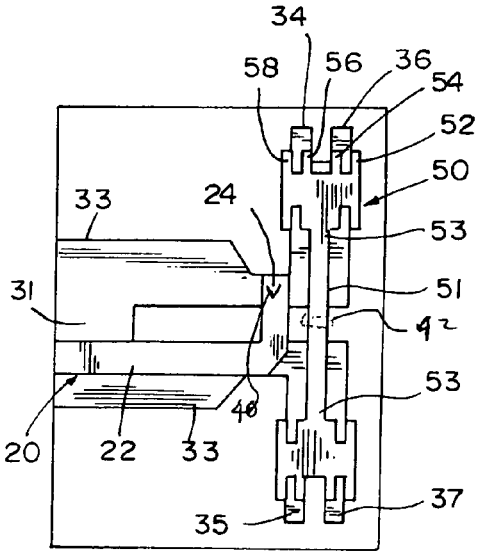
FIG. 12 is a plane top view of the antenna of FIG. 11.
Figure 13:
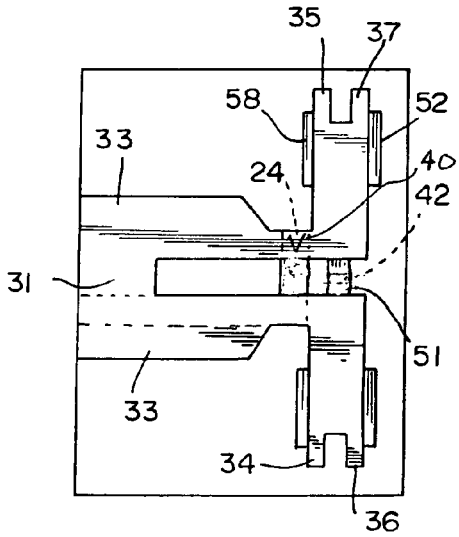
FIG. 13 is a bottom view of the antenna of FIG. 11.

The antenna 11 of FIGS. 11 through 13 includes, in addition to the first conductive layer 20 on a first surface of the dielectric substrate 12 and a second conductive dipole 30 on the opposite surface of the dielectric substrate 12, a ground conductive layer 60 separated from the second conductive layer 30 by the lower dielectric layer 16. Also, a third conductive element 50 is provided on the same surface of the dielectric substrate 12 as the first conductive element 20. The third conductive element 50 is a directive dipole. It includes a center strip 51 having a pair of end portions 53. This is generally a barbell-shaped conductive element. It is superimposed over the strips 34, 36, 35, 37 of the second conductive layer 30. It is connected to the ground layer 60 by a via 42 extending through the dielectric substrate 12 and dielectric layer 16.

The directive dipole 50 includes a plurality of fingers superimposed on a portion of the edges of each of the strips 34, 36, 35, 37. As illustrated, the end strips 52, 58 are superimposed and extend laterally beyond the lateral edges of strips 34, 36, 35, 37. The inner fingers 54, 56 are adjacent to the inner edge of strips 34, 36, 35, 37 and do not extend laterally therebeyond.

Preferably, the permeability or dielectric constant of the dielectric substrate 12 is greater than the permeability or dielectric constant of the dielectric layer 16. Also, the thickness h1 of the dielectric substrate 12 is substantially less than the thickness h2 of the dielectric layer 16. Preferably, the dielectric substrate 12 is at least half of the thickness of the dielectric layer 16.

The polygonal perimeter of the end portion 53 of the dipole directive 50 has a similar shape of the PEAN03 fractal shape directive dipole. It should also be noted that the profile of the antenna 12 gives the appearance of a double planar inverted-F antenna (PIFA).

Figure 14:
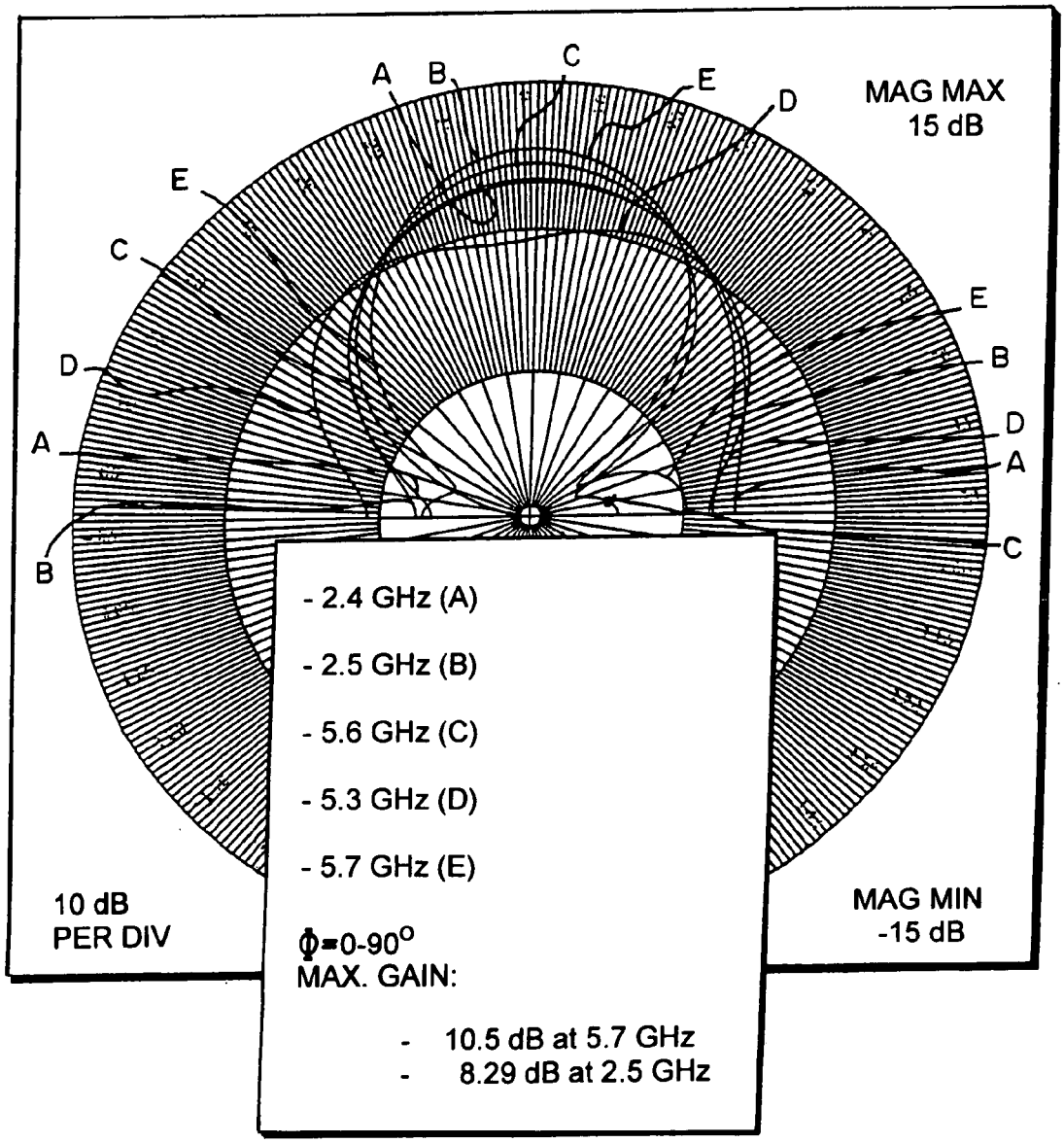
FIG. 14 is a graph of the directional gain of the antenna of FIG. 11 for five frequencies.
Figure 15:
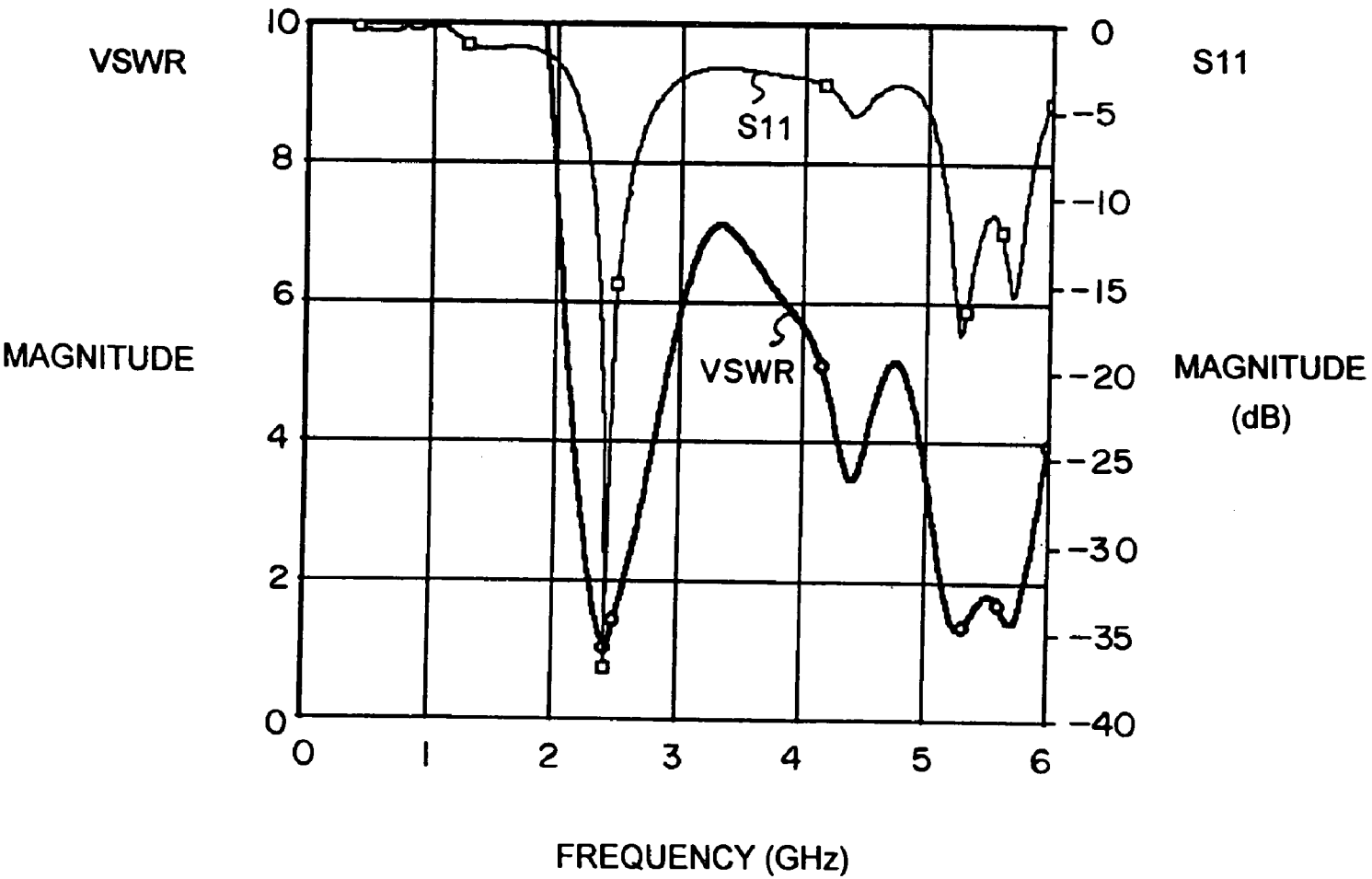
FIG. 15 is a graph of frequency versus VSWR and S11 of the antenna of FIG. 11.

FIG. 14 is a graph of the directional gain of antenna 12, while FIG. 15 shows a graph for the VSWR and the gain S11. Five frequencies are illustrated in FIG. 10. The maximum gain are above 7 dB and are 8.29 dB at 2.5 GHz and 10.5 dB at 5.7 GHz. The VSWR in FIG. 15 is for at least two frequency bands that are below 2.

Figure 16A:
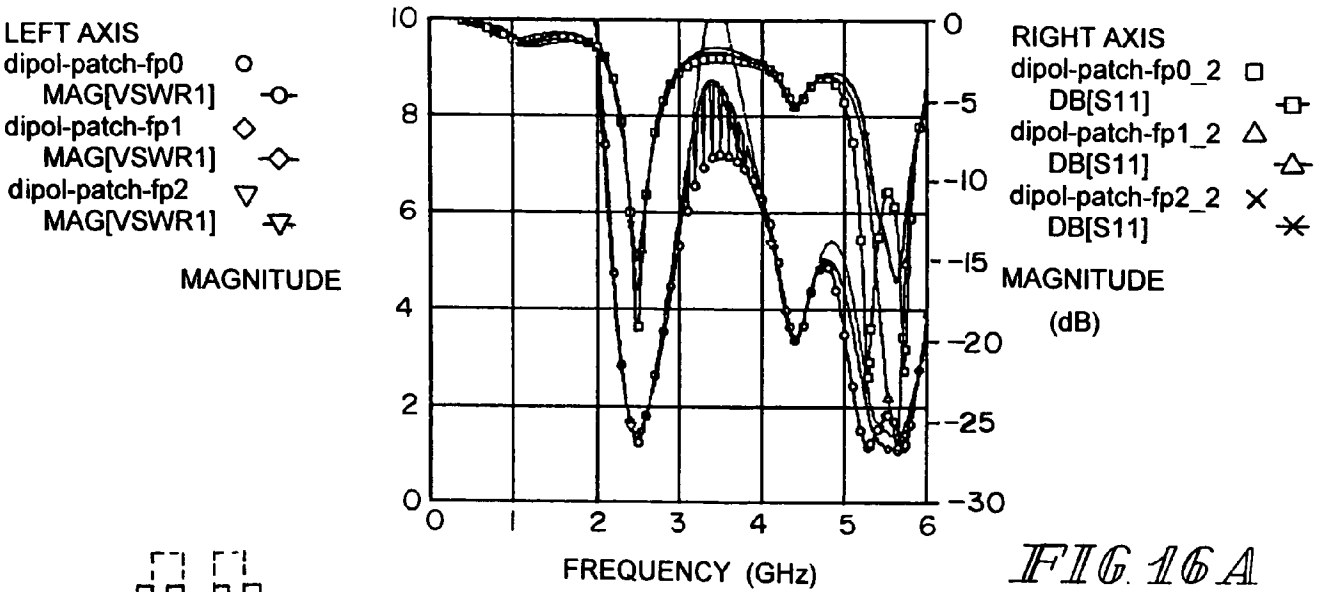
FIG. 16A is a graph showing the effects of changing the feed point or via 40 for the feed positions illustrated in FIG. 16B for the dipole antenna of FIG. 11.
Figure 16B:
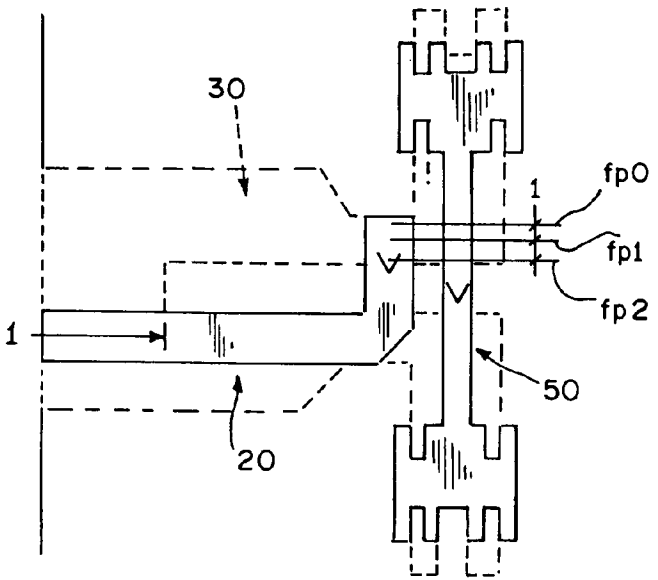
Figure 17:
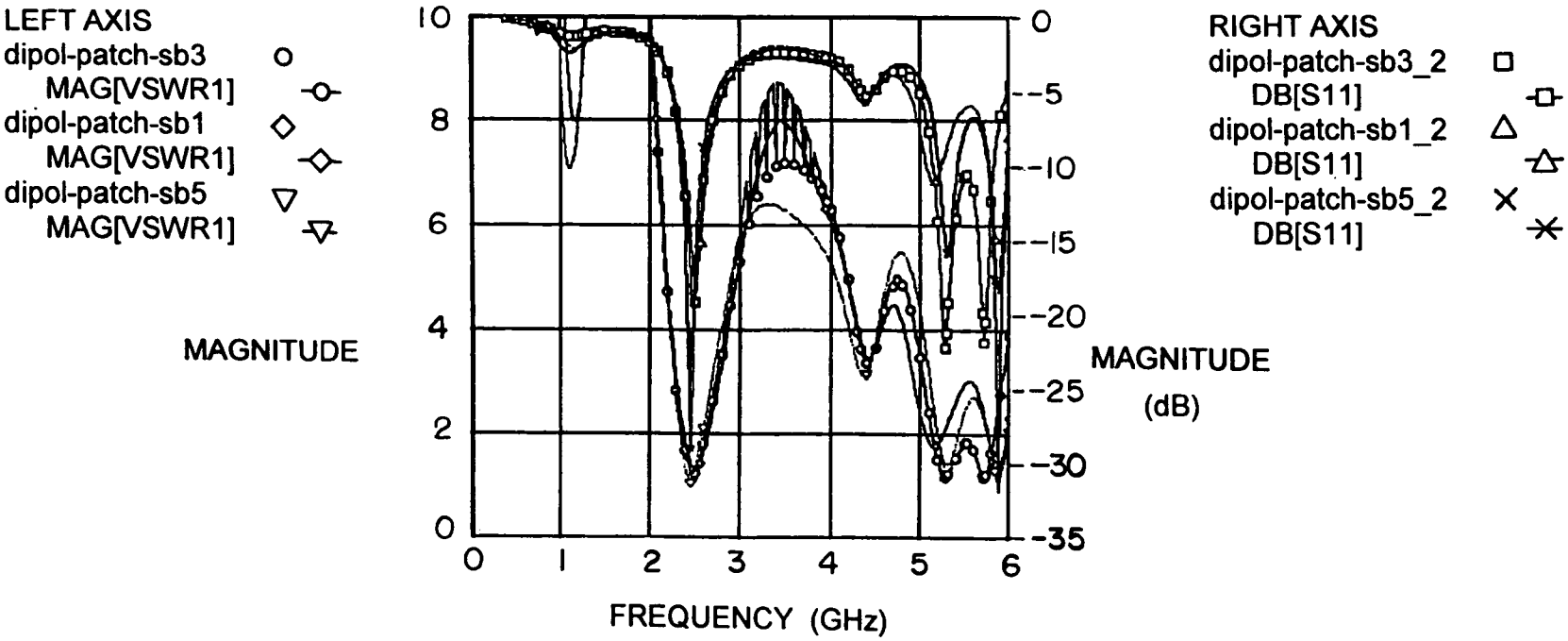
FIG. 17 is a graph showing the effects of changing the width of slot S for the dipole antenna of FIG. 11.
Figure 18A:
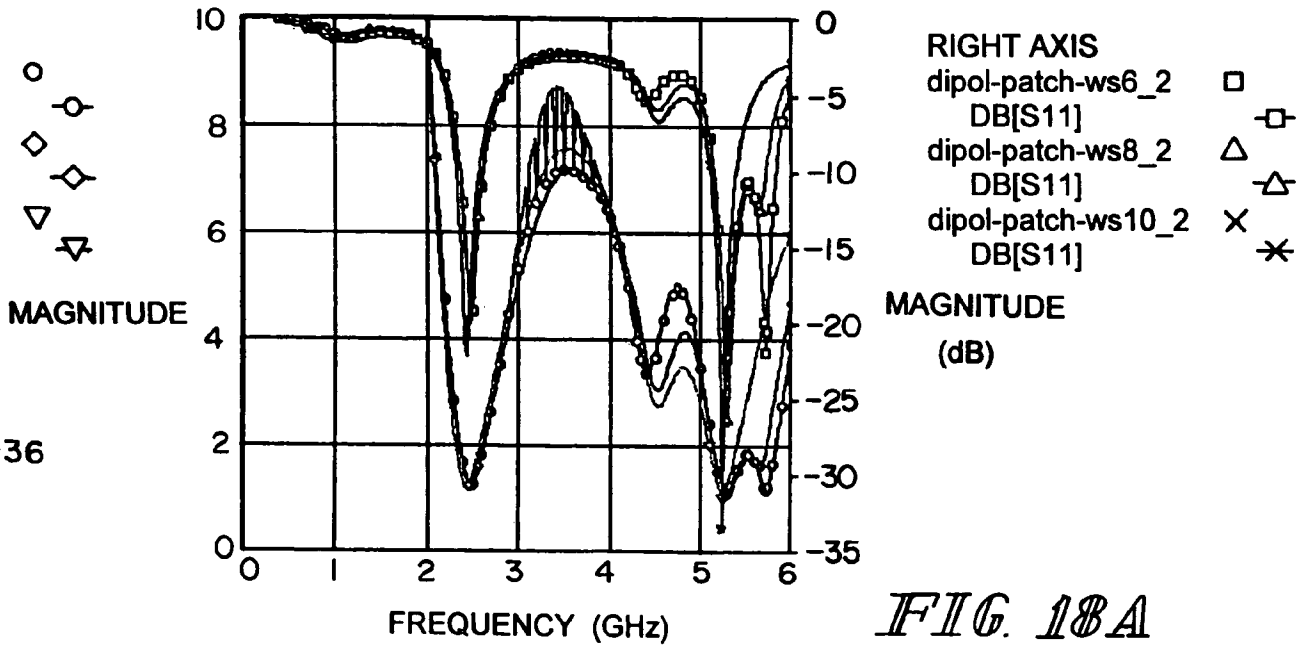
FIG. 18A is a graph showing the effects of changing the width of the dipole, as illustrated in FIG. 18B, of the antenna of FIG. 11.
Figure 18B:
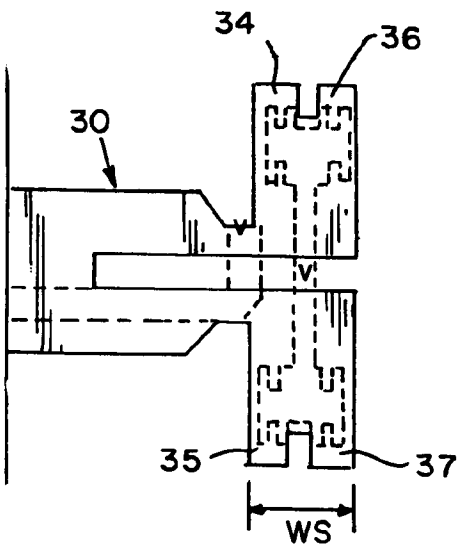
Figure 19A:
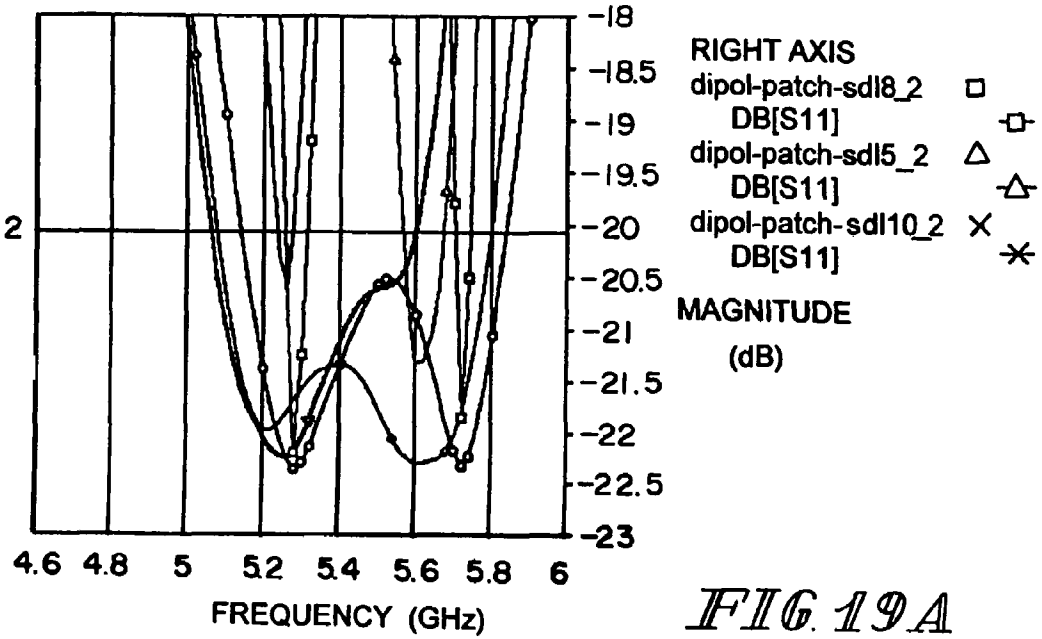
FIG. 19A is a graph of the second frequency showing the effect of changing the length of the directive dipole, as illustrated in FIG. 19B, of the dipole antenna of FIG. 11.
Figure 19B:
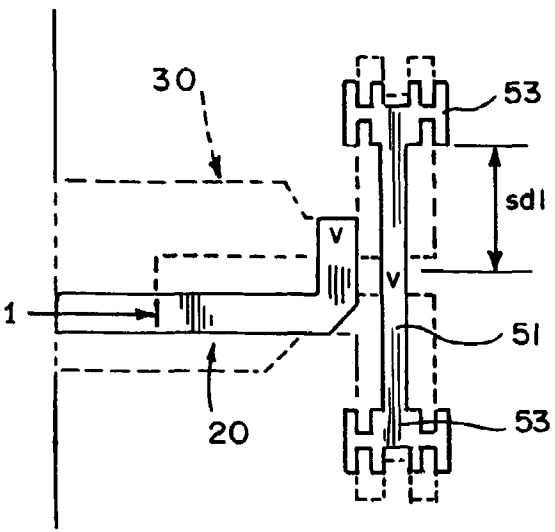

FIGS. 16A and 16B show the effect of the feed point fp or via 40. Feed point zero is similar to that shown in FIG. 15. FIG. 17 shows the effect of the slot width S for 1 mm, 3 mm and 5 mm. The 3 mm width corresponds generally to that of FIG. 15. FIGS. 18A and 18B show the effect of the dipole strip width SW for widths of 6 mm, 8 mm and 10 mm. The 6 mm width corresponds to that of FIG. 15. FIGS. 19A and 19B show the effect of the length SDL of portion 51 of the directive dipole 50 on the second frequency in the 5 GHz range. The 8 mm width corresponds generally to that of FIG. 15.

Although not shown, a number of via holes around the dipole through the insulated layer 12 may be provided. These via holes would provide pseudo-photonic crystals. This would increase the total gain by reducing the surface waves and the radiation in the dielectric material. This is true of both antennas.

Although the present disclosure has been described and illustrated in detail, it is to be clearly understood that this is done by way of illustration and example only and is not to be taken by way of limitation. The scope of the present disclosure is to be limited only by the terms of the appended claims.

What is claimed:

1. A dipole antenna for a wireless communication device comprising:

a first conductive element superimposed a portion of and separated from a second conductive element by a first dielectric layer;

the second conductive element being generally U-shaped;

the second conductive element including a plurality of spaced conductive strips extending an equal length transverse from adjacent ends of each leg of the U-shape; and a first conductive via connects the first and second conductive elements through the first dielectric layer such that each strip on a leg being dimensioned for a different λo relative to the first conductive via.

2. The antenna according to claim 1, wherein the first and second conductive elements are each planar.

3. The antenna according to claim 1, wherein each strip has a width less than 0.05 λo and a length of less than 0.5 λo.

4. The antenna according to claim 1, wherein the antenna is omni-directional and a gain exceeding 4 dB.

5. The antenna according to claim 1, wherein the first dielectric layer is a substrate, and the first and second conductive elements are printed elements on the substrate.

6. The antenna according to claim 1, wherein the plurality of strips are parallel to each other.

7. The antenna according to claim 1, wherein the first conductive element is L-shaped.

8. The antenna according to claim 7, wherein one of the legs of the L-shape is superimposed one of the legs of the U-shape.

9. The antenna according to claim 8, wherein the first conductive via connects the other leg of the L-shape to the other leg of the U-shape.

10. The antenna according to claim 7, wherein the first conductive via connects an end of one of the legs of the L-shape to one of the legs of the U-shape.

11. The antenna according to claim 7, wherein one of leg of the L-shape is superimposed on one leg of the U-shape and a portion of another leg of the L-shape is superimposed on another leg of the U-shape.

12. A dipole antenna for a wireless communication device comprising:

a first conductive element superimposed a portion of and separated from a second conductive element by a first dielectric layer;

a first conductive via connects the first and second conductive elements through the first dielectric layer;

the first conductive element being L-shaped;

the second conductive element being generally U-shaped;

the second conductor including a plurality of spaced conductive strips extending transverse from adjacent ends of each leg of the U-shape;

each strip on a leg being dimensioned for a different λo;

a ground plane conductor superimposed and separated from the second conductive element by a second dielectric layer;

a third conductive element superimposed and separated from the strips of the second conductive element by the first dielectric layer; and a second conductive via connecting the third conductive element to the ground conductor through the dielectric layers.

13. The antenna according to claim 12, wherein the first and third conductive elements are co-planar.

14. The antenna according to claim 12, wherein the third conductive element includes a plurality of fingers superimposed a portion of lateral edges of each of the strips.

15. The antenna according to claim 12, wherein a first and last finger superimposed a first and last strip on each leg of the U-shape extend laterally beyond the lateral edges of the respective strips.

16. The antenna according to claim 12, wherein the permeability of the first dielectric layer is substantially greater than the permeability of the second dielectric layer.

17. The antenna according to claim 16, wherein the thickness of the first dielectric layer is substantially less than the thickness of the second dielectric layer.

18. The antenna according to claim 12, wherein the thickness of the first dielectric layer is at least half the thickness of the second dielectric layer.

19. The antenna according to claim 12, wherein the antenna is directional and has a gain exceeding 7 dB.

* * * * *